US007527015B1

(12) United States Patent
Peter

(10) Patent No.: US 7,527,015 B1
(45) Date of Patent: May 5, 2009

(54) HIDE-A-STEP DOCK SYSTEM

(76) Inventor: Valentine J. Peter, 16507 Lake Park Point, South Bend, NE (US) 68058

( * ) Notice: Subject to any disclaimer, the term of this patent is extended or adjusted under 35 U.S.C. 154(b) by 303 days.

(21) Appl. No.: 11/524,506

(22) Filed: Sep. 20, 2006

Related U.S. Application Data

(60) Provisional application No. 60/718,668, filed on Sep. 20, 2005.

(51) Int. Cl.
*B63B 17/00* (2006.01)

(52) U.S. Cl. ..... 114/362

(58) Field of Classification Search ..... 114/362
See application file for complete search history.

(56) References Cited

U.S. PATENT DOCUMENTS 3,268,031 A * 8/1966 Hampson ..... 182/220
6,422,340 B1 * 7/2002 Grundler ..... 182/84
6,923,140 B1 * 8/2005 Cook ..... 114/362

* cited by examiner

*Primary Examiner*—Stephen Avila
(74) *Attorney, Agent, or Firm*—Suiter Swantz pc llo

(57) ABSTRACT

The present invention is a docking system. The docking system includes a first step and a second step configured for adjustably connecting with the first step. The second step is further configured for being adjusted relative to the first step along a vertical plane from a first position relative to the first step to a second position relative to the first step, the second position being different than the first position. The second step is further configured for being secured in at least one of the first position and the second position. Further, the docking system is configured for connecting to a floating dock.

6 Claims, 4 Drawing Sheets

HIDE-A-STEP DOCK SYSTEM

CROSS-REFERENCE TO RELATED APPLICATIONS

The present application claims priority under 35 U.S.C. § 119(e) to U.S. Provisional Application No. 60/718,668 entitled: Hide-A-Step Dock System filed Sep. 20, 2005, which is hereby incorporated by reference in its entirety.

FIELD OF THE INVENTION

The present invention generally relates to the field of docking watercraft, and more particularly, to a hide-a-step dock system.

BACKGROUND OF INVENTION

Many lakes and sand pits rise with the spring rains and gradually fall as the summer irrigation season begins. Often the shore-lines of such areas are lined with floating docks for allowing watercraft owners to secure their watercraft. Present docking systems are disadvantageous in that they do not account for the variable water level. For example, as the water level gradually decreases, a gang plank, which many floating docks employ, may begin to gradually decline. As the water level continues to decrease over time, the corresponding decline of the gang plank may result in the gang plank being angled at a steep incline, thereby making it more difficult for a user to traverse up or down the gang plank.

Therefore, it would be desirable to provide a docking system which addresses the above-referenced shortcomings of current solutions.

SUMMARY OF THE INVENTION

Accordingly, an embodiment of the present invention is directed to a docking system, including: a first step; and a second step configured for adjustably connecting with the first step, the second step further configured for being adjusted relative to the first step along a vertical plane from a first position relative to the first step to a second position relative to the first step, the second position being different than the first position, the second step being further configured for being secured in at least one of the first position and the second position, wherein the docking system is configured for connecting to a floating dock.

A further embodiment of the present invention is directed to a watercraft securing system, including: a first step; a second step configured for adjustably connecting with the first step, the second step further configured for being adjusted relative to the first step along a vertical plane from a first position relative to the first step to a second position relative to the first step, the second position being different than the first position, the second step being further configured for being secured in at least one of the first position and the second position; and a floating dock, wherein the second step is configured for connecting to the floating dock.

An additional embodiment of the present invention is directed to a watercraft securing system kit, including: a plurality of steps, including a first step and a second step, the second step being configured for adjustably connecting with the first step, the second step further being configured for being adjusted relative to the first step along a vertical plane from a first position relative to the first step to a second position relative to the first step, the second position being different than the first position, the second step being further configured for being secured in at least one of the first position and the second position; a plurality of mounting brackets configured for mounting the first step to a surface; a floating dock frame configured for connecting to the second step; and a plurality of endpoles configured for connecting to the floating dock frame and further configured for anchoring the floating dock frame.

BRIEF DESCRIPTION OF THE DRAWINGS

The numerous advantages of the present invention may be better understood by those skilled in the art by reference to the accompanying figures in which.

DESCRIPTION OF INVENTION

Reference will now be made in detail to the presently preferred embodiments of the invention, examples of which are illustrated in the accompanying drawings.

Figure 1:
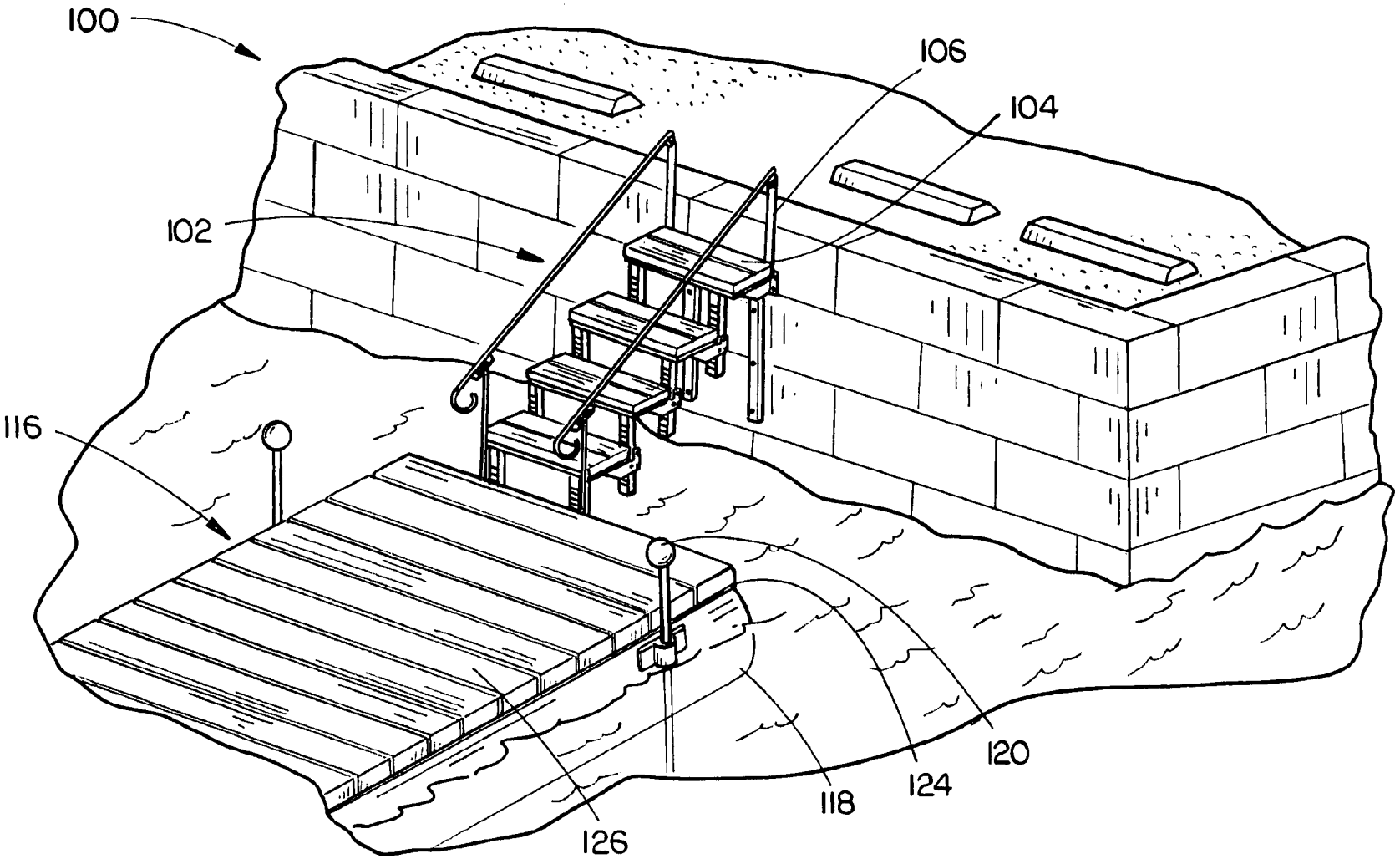
FIGS. 1 and 2 illustrate a watercraft securing system in accordance with exemplary embodiments of the present invention.
Figure 2:
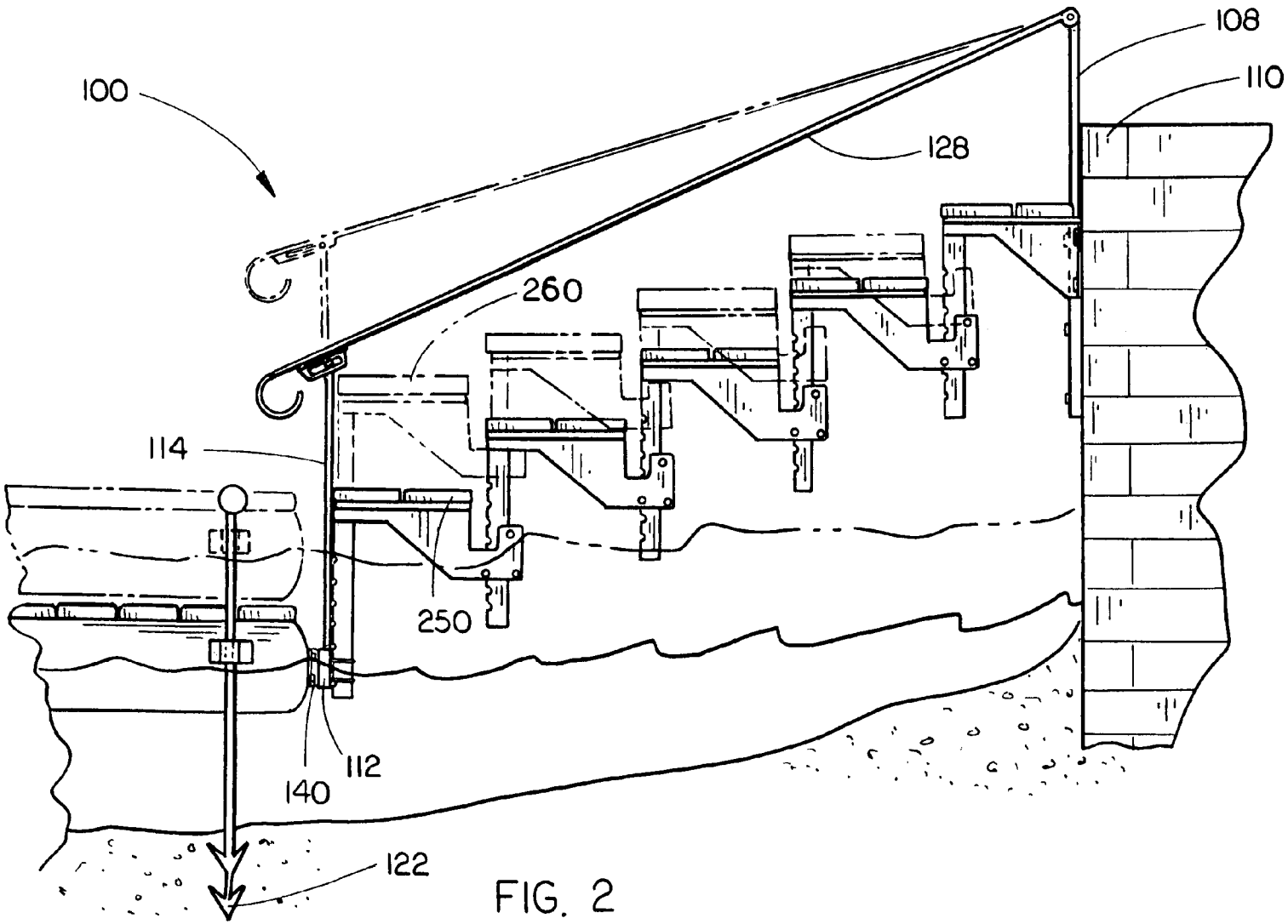

FIGS. 1 and 2 illustrate a watercraft securing system 100 in accordance with exemplary embodiments of the present invention. In a current embodiment, the watercraft securing system 100 includes a docking system 102. The present invention provides a docking system 102 which adjusts to varying water levels. (as shown in FIG. 2). In the exemplary embodiment, the docking system 102 includes a plurality or series of steps 104. For example, the plurality of steps 102 may include a first step and a second step. In the present embodiment, each step provides a horizontal surface area on which a user may place ones foot. For instance, each step of the series of steps 104 may form steps that are four feet wide by twelve inches deep. Further, the second step may be configured for adjustably connecting with the first step. For instance the second step may be configured for being adjusted relative to the first step along a vertical plane from a first position 250 relative to the first step to a second position 260 relative to the first step, the second position being different than the first position. Still further, the second step is configured for being secured in at least one of the first position and the second position.

Figure 3:
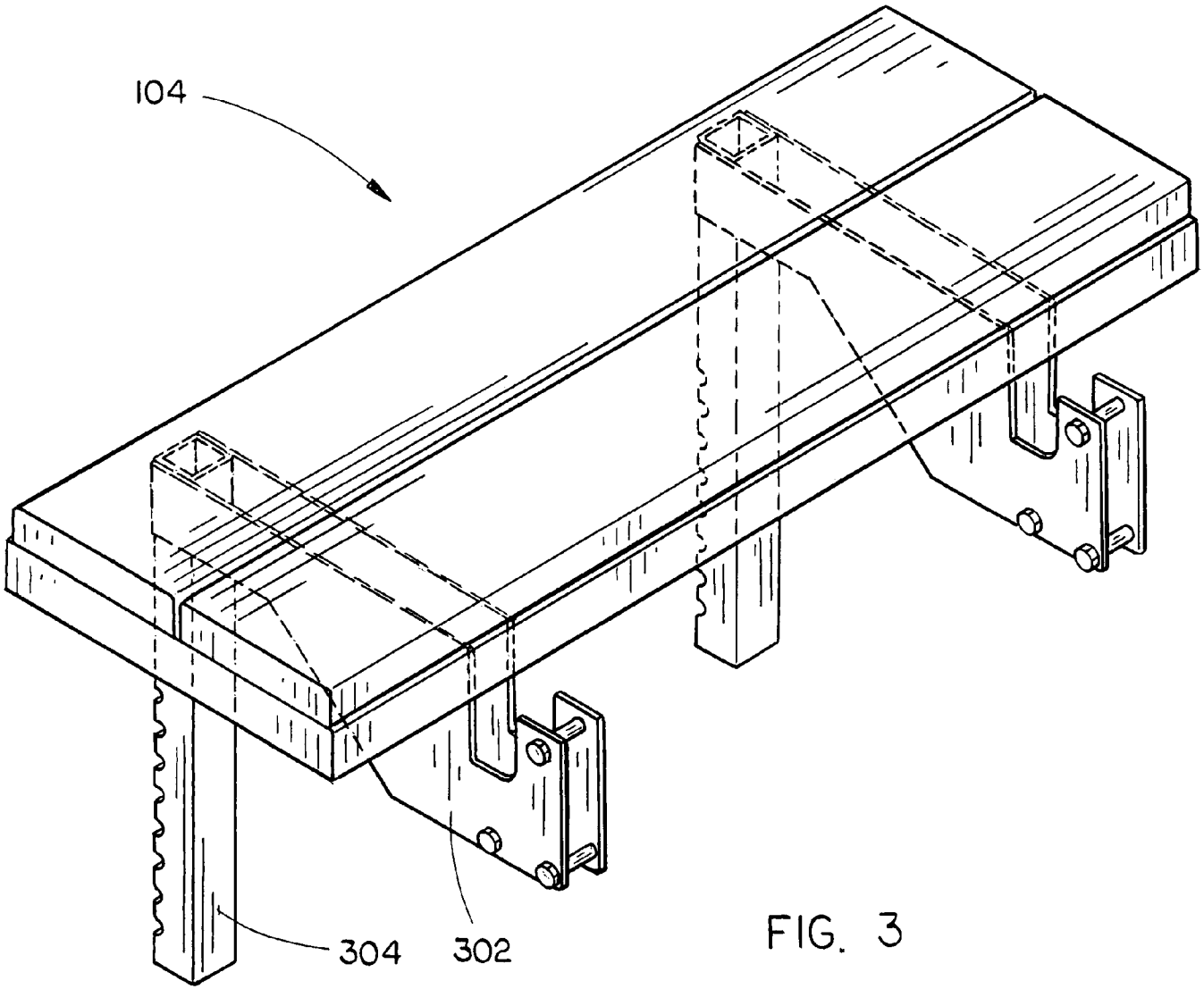
FIG. 3 is an isometric view of a step of a docking system in accordance with an exemplary embodiment of the present invention.
Figure 4:
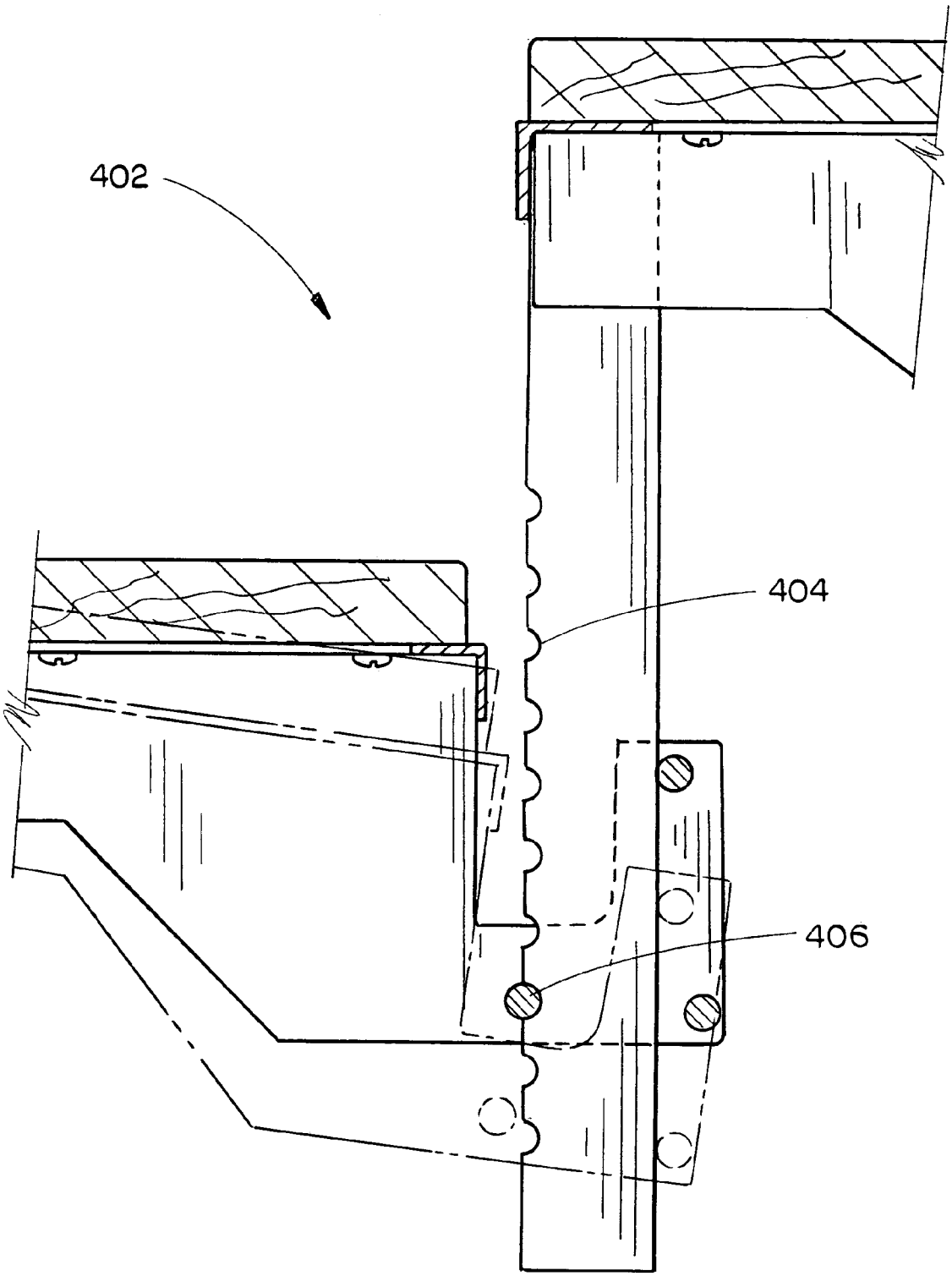
FIG. 4 is a sectional view of an adjustable locking assembly of a docking system in accordance with an exemplary embodiment of the present invention.

In a present embodiment, at least one step included in the plurality of steps 104 is configured with one or more (ex.—two) framing brackets 302 (as shown in FIG. 3). In further embodiments, at least one step (ex.—the first step) included in the plurality of steps 104 is configured with one or more (ex.—two) connecting tubes 304 for connecting the at least one step with an adjoining step (ex.—the second step) included in the plurality of steps via the one or more framing brackets. For instance, one or more connecting tubes 304 of the first step may be received within one or more framing brackets 302 of the second step (as shown in FIGS. 2 and 4) for adjustably connecting the first step and the second step via an adjustable locking assembly, such as a notched connecting tube assembly or pin and groove assembly 402 (as shown in FIG. 4). In the exemplary embodiments, the adjustable locking assembly 402 allows one or more of the steps included in the plurality of steps to be individually adjusted and to be locked in place when weight is applied to the step, such as when the step is stepped upon. For example, with the notched connecting tube assembly or pin and groove assembly 402, each connecting tube 304 may be formed with notches 404, while each framing bracket includes a pin 406. The notches 404 of the connecting tube 304 are capable of receiving the pin 406. Further, the notches 404 may be formed so that each step may be adjusted to varying distances from an adjoining step. For instance, the notches may be established so that the maximum vertical drop to an adjoining step would be seven inches. In use, as weight is applied to the step 104, the connecting tube 304 slides within the framing bracket until the pin 406 is engaged by one of the notches of the connecting tube 304. Each step may be attached one at a time in like manner to form the series of steps 104 of docking system 102 which when connected, may remain parallel to a water surface when the steps are not in use. It is contemplated that the series of steps 104 may include a varying number (ex.—fifteen) of steps as desired. In alternative embodiments, each framing bracket 302 may be coupled to a connecting tube 304 via a plurality of fasteners including nuts, bolts, washers, and the like. In the present embodiment, the vertical drop between a pair of steps included of the plurality of steps 104 may be adjusted or may adjust with changes in water level, while allowing the overall length of the docking system 102 to remain unaltered.

In additional embodiments, a spacer may be placed between each connecting tube 304 and framing bracket 302 for preventing the connecting tube and framing bracket from unduly wearing on one another. For example, a UHMW (Ultra High Molecular Weight) spacer may be employed to prevent a stainless steel connecting tube from causing undue wear to a surrounding aluminum framing bracket. Such configuration may prevent the two metals from making contact and thus, possibly increase the lifespan of the docking system 102. In further embodiments, a tension spring system may be included which maintains a tension against a connecting tube 304 when the connecting tube is, received within the framing bracket 302 for keeping the connecting tube aligned within the framing bracket.

In an exemplary embodiment, the docking system 102, includes one or more mounting brackets 106 configured for mounting a first end 108 (ex.—first step) of the docking system to a desired structure or surface, such as a sea wall 110. In current embodiments, the mounting brackets 106 are secured to the desired structure or surface 110 via use of a plurality of fasteners including stainless steel bolts, nuts, washers, and the like.

In a further embodiment, the docking system 102 includes one or more attachment tubes 112 for connecting a second end 114 (ex.—second step) of the docking system to a floating dock 116 included as part of the watercraft securing system 100. By connecting on the first end 108 with a seawall 110 and, by further connecting on the second end 114 with the floating dock 116, the docking system 102 of the present invention allows the series of steps to vertically adjust with the water level (and floating dock) thereby replacing the current gang plank system which many floating docks presently employ.

In a present embodiment, the floating dock 116 includes one or more floatation devices 118 (ex.—two floats) for stabilizing the floating dock. In current embodiments, the floating dock 116 further includes one or more endpoles 120 for anchoring the floating dock. For instance, the floating dock 116 may include two, four inch-diameter endpoles 120 which are approximately twelve feet in length. Each endpole may include an anchoring mechanism such as a flat plate or barb 122 attached to the end of the pole which makes contact with a ground surface.

In further embodiments, the floating dock 116 includes a floating dock frame 124 configured for coupling with the one or more endpoles 120. It is contemplated that the floating dock 116 may be composed of various materials, such as aluminum sheet metal and/or galvanized steel. In an exemplary embodiment, the floating dock 116 further includes floating dock decking 126 configured for coupling with the floating dock frame 124 and forming a support platform or surface of the floating dock 116. It is contemplated that the floating dock decking 126 may be a weather-resistant material, such as composite fiberglass. The floating dock 116 further includes one or more receiving brackets 140 for connecting with the docking system 102.

In further embodiments, a sound dampening mechanism, such as a neoprene gasket, may be placed within each endpole to assist in dampening the sound generated when the endpoles make contact with other portions, such as with the frame 124, of the floating dock 116.

In additional embodiments, the watercraft securing system 100 includes a handrail 128 having a first end configured for being pivotally connected about a fixed point and a second end configured for connection to one or more steps (ex.—the second step) included in the plurality of steps 102. In a present embodiment, the handrail 128 is further configured to pivot in the vertical plane in a same direction as the one or more steps (ex.—the second step) included in the plurality of steps when the one or more steps moves along the vertical plane. Thus, the handrail 128 of the present invention is configured to pivot as the water level changes (e.g., rises, drops). In an exemplary embodiment, the height of the handrail remains constant and such rail may be mounted to either one or both sides of the docking system 102.

In further embodiments, one or more floatation devices may be attached to the series of steps 104 of the docking system 102 depending upon the overall size of the floating dock 116 to which the docking system 102 is being attached.

In an exemplary embodiment, any combination of the above-referenced elements of a watercraft securing system may be packaged as part of a watercraft securing system kit. It is further contemplated that the watercraft securing system kit may also include an instruction manual. Such manual may include a detailed description of how to assemble the watercraft securing system and may further include drawings showing the various elements.

It is contemplated that the plurality of steps 104 may be composed of a variety of materials including such materials which are relatively weather resistant. For example, the steps may be formed of decking material, such as composite fiberglass decking which is commonly used around swimming pools. Further, the framing brackets 106 of the steps 104 may be composed of various materials including plastic and metal (e.g., aluminum, galvanized steel).

In alternative embodiments, the steps 104 may be adjusted via hydraulic jacking devices implemented with or as part of the connecting tubes 304 and/or framing brackets 302. In additional embodiments, one or more steps included in the plurality of steps 104 may include a central support connected to a bottom surface of the step for stabilizing the step.

In additional embodiments, the docking system 102 may be further configured for being connected with a boat lift, such as a personal watercraft electric boat lift. The series of steps 104 of the docking system 102 may be connected with the boat lift in such a manner that said series of steps may unfold/fold with a scissor-like movement. For example, each step of the series of steps 104 may unfold via the connection with the boat lift one at a time until the full series of steps is presented for use. In exemplary embodiments, the boat lift may be connected with a seawall, permanent dock or the like.

It is believed that the present invention and many of its attendant advantages will be understood by the foregoing description. It is also believed that it will be apparent that various changes may be made in size, materials, shape, form, function, manner of operation, assembly and use of the components thereof without departing from the scope and spirit of the invention or without sacrificing all of its material advantages. The form herein before described being merely an explanatory embodiment thereof.

What is claimed is:

1. A watercraft securing system kit, comprising:

a plurality of steps, including a first step and a second step, the second step being configured for adjustably connecting with the first step, the second step further being configured for being adjusted relative to the first step along a vertical plane from a first position relative to the first step to a second position relative to the first step, the second position being different than the first position, the second step being further configured for being secured in at least one of the first position and the second position;

a plurality of mounting brackets configured for mounting the first step to a surface;

a floating dock frame configured for connecting to the second step;

a plurality of endpoles configured for connecting to the floating dock frame and further configured for anchoring the floating dock frame; and a handrail having a first end, configured for being pivotally connected about a fixed point, and a second end, configured for connection to the second step, the handrail being further configured to pivot in the vertical plane in a same direction as the second step when the second step moves along the vertical plane.

2. A watercraft securing system kit as claimed in claim 1, further comprising:

a plurality of floatation devices for connecting to the floating dock frame for stabilizing the floating dock frame.

3. A watercraft securing system kit as claimed in claim 2, wherein each of the plurality of endpoles include a sound dampening mechanism configured for dampening sound generated when the endpoles contact the floating dock frame.

4. A watercraft securing system kit as claimed in claim 3, further comprising:

a plurality of spacers each configured for being placed between connecting tubes and framing brackets of the plurality of steps for reducing frictional contact between the connecting tubes and framing brackets.

5. A watercraft securing system kit as claimed in claim 4, further comprising:

a plurality of receiving brackets, each of the plurality of receiving brackets being configured for receiving an attachment tube of the second step for securing the second step to the floating dock frame.

6. A watercraft securing system kit as claimed in claim 5, further comprising:

floating dock decking configured for being connected to the floating dock frame for forming a support surface.

* * * * *